US007069892B2

(12) United States Patent
Lechner et al.

(10) Patent No.: US 7,069,892 B2
(45) Date of Patent: Jul. 4, 2006

(54) CAMSHAFT FOR AUTOMOTIVE ENGINES IN PARTICULAR

(75) Inventors: Martin Lechner, Stuttgart (DE); Falk Schneider, Münchingen (DE)

(73) Assignee: MAHLE Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 11/284,388

(22) Filed: Nov. 21, 2005

(65) Prior Publication Data

US 2006/0107913 A1 May 25, 2006

(30) Foreign Application Priority Data

Nov. 20, 2004 (DE) ..... 10 2004 056 191

(51) Int. Cl.
*F01L 1/04* (2006.01)

(52) U.S. Cl. ..... 123/90.6; 123/90.27; 29/888.1

(58) Field of Classification Search ..... 123/90.2, 123/90.27, 90.31, 90.39, 90.44, 90.6, 90.15, 123/90.16, 90.17, 90.18; 29/888.1; 74/559, 74/567, 569

See application file for complete search history.

(56) References Cited

U.S. PATENT DOCUMENTS 5,253,546 A 10/1993 Elrod et al.
5,505,168 A * 4/1996 Nagai et al. ..... 123/90.17
5,746,166 A * 5/1998 Valasopoulos ..... 123/90.17

FOREIGN PATENT DOCUMENTS

DE 32 12 663 10/1983
DE 39 33 923 11/1991

* cited by examiner

*Primary Examiner*—Thomas Denion
*Assistant Examiner*—Ching Chang
(74) *Attorney, Agent, or Firm*—Collard & Roe, P.C.

(57) ABSTRACT

A camshaft for automotive engines in particular, comprising at least one first cam (5') and at least one cam segment (6) which is rotatable to a limited extent with respect to the first cam (5') and exercises the full or partial function of a second cam (4), with which an inner shaft (3) and an outer shaft (2) are arranged concentrically one inside the other and also rotatably with respect to one another, the first cam (5') and the cam element (6) surround the outer shaft (2) on the periphery at least in part, the first cam (5') is fixedly connected to the outer shaft (2), and the respective cam segment (6) is connected to the inner shaft (3) in a rotationally fixed manner, the cam segment (6) is provided with an inside circumferential surface extending over only a section of the circle running concentrically in a circular cylindrical pattern with respect to the inner shaft (3) and the outer shaft (2), the inside circumferential surface of the cam segment (6) is supported on a guide area (2') formed by the outer shaft (2) or fixedly connected to it, is to be assembled from completely machined parts to form a finished camshaft which does not need to be post-machined, such that there is no change in geometry on the completely machined parts.

Figure 1:
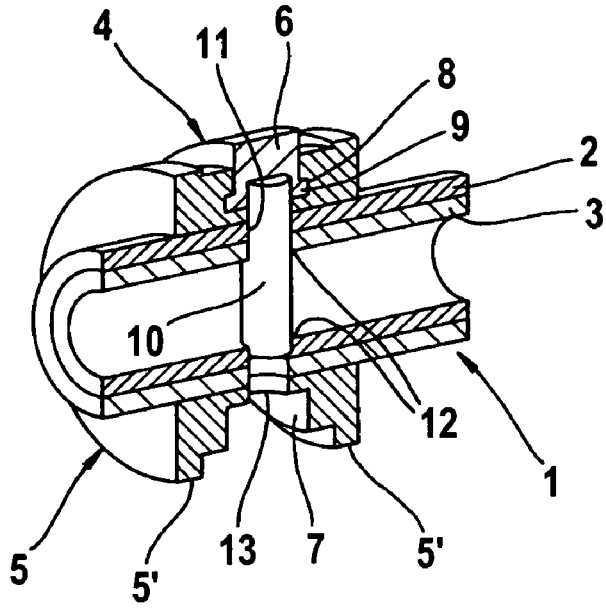

To this end, such a camshaft is characterized by the following features:

the cam segment (6) is mounted on the guidance area (2') provided for the outer shaft (2) by means of a tongue-and-groove connection (8, 9) running on a circular section that is limited at the circumference, whereby the circular section is designed to be coaxial with the outer shaft (2) and the inner shaft (3), the cam segment (6) which is connected to the inner shaft in a rotationally fixed manner is displaceable with respect to the inner shaft (3) to a limited extend radially.

12 Claims, 7 Drawing Sheets

CAMSHAFT FOR AUTOMOTIVE ENGINES IN PARTICULAR

The invention relates to a camshaft according to the preamble of patent Claim 1.

Such a camshaft is known from German Patent DE 39 33 923 A1, for example. With this camshaft, the respective rotary cam segment is fixedly connected to the inner shaft in all directions. This cam segment has circular cylindrical arc segments on the inside radially for support on the circular cylindrical outer lateral surface of the outer shaft. Given the manner in which the cam segment is fixedly connected to the inner shaft there, it is difficult to be able to reliably maintain an ideal bearing clearance between the adjacent surfaces between the cam segment and the outside circumference of the outer shaft.

The present invention addresses the problem of being able to mount rotary cam segments easily and in an accurate position on the camshaft in the case of a generic camshaft. It should be possible here in particular to be able to join a generic camshaft comprised of cams that have been through final machining to form a finished camshaft such that no more reworking is necessary on the components that have been joined including the first cams and the rotary cam segments. In addition, it should be ensured that the cam segments which are rotatably mounted with respect to the outer shaft can be joined to form a desired tight bearing clearance in an absolutely reliable and reproducible manner.

This problem is solved primarily by the design of a generic camshaft according to the characterizing features of patent Claim 1.

Advantageous and expedient embodiments are the object of the dependent claims.

This invention is based on the general idea of aligning the rotary cam segments, which are mounted on the outer shaft and are rotary with respect to the latter, in the correct position exclusively on elements of the outer shaft and/or components that are fixedly connected to the latter and guiding them during operation of the camshaft. Through the alignment and guidance of the movable cam segments exclusively in areas of the camshaft, the connection of the camshaft segments to the inner shaft at the time of manufacture cannot have any negative effect at all on manufacturing precision. This is a great advantage when joining a generic camshaft with respect to achieving a high manufacturing accuracy because manufacturing inaccuracies can easily occur with the camshafts known in the state of the art so far, especially when joining the cam segments to the inner shaft. The prerequisite for radial mounting of an inventive cam segment on the outer shaft is a possible radial relative displaceability between the cam segment and the inner shaft which is at least narrowly limited on the outer shaft.

In the case of a camshaft designed according to this invention, first, all cam parts to be fixedly joined to the outer shaft or additional components are first joined, preferably with the final precision. The aforementioned components to be joined are preferably already completely machined at the time of joining. When using first cams that have not been completely machined and/or other fixedly joined components that have not been completely machined, the final machining takes place before joining the movable cam segments. The movable cam segments that are open at the periphery are joined by placing these cam segments radially onto the receiving areas of the outer shaft to thereby be connected to the inner shaft which has already been inserted into the outer shaft. In this connection, the accuracy of the fit in the radial direction is determined exclusively by receiving areas in the outer shaft. The movable cam segment is connected to the inner shaft in a rotationally fixed and axially secure manner. The guidance and bearing elements which are crucial for the radial fixation of the movable cam segment are situated exclusively in areas of the outer shaft, i.e., they are designed as components which are fixedly connected to the outer shaft.

The rotationally fixed connection between the movable cam segment and the inner shaft is accomplished via a pin running radially, fixedly engaging the movable cam segment. This pin runs through recesses in the outer shaft, extending in the circumferential direction so that a preselectable relative rotation is possible between the inner shaft and the outer shaft. In the support of the pin in the inner shaft, an accurate fit must be ensured, especially in the direction of rotation. A sliding fit and/or clearance fit is to be provided especially in the radial direction, ensuring a low mobility at least in the radial direction in relation to the axes of the shafts. This radial mobility is necessary to prevent redundant support because the radial positional accuracy of the moving cam segments should be determined only thereby from the positioning of these cam segments in the outer shaft.

In an especially advantageous embodiment of this invention, a second cam is composed of a base part that can be fixedly joined to the outer shaft and a cam segment that rotates with the latter. The radial bearing of the movable cam segment in the base part is provided by arc-shaped tongue-and-groove connections. The circular guide path runs concentrically with respect to the axis of the inner and outer shafts. In order to be able to introduce the cam segment in a completely machined state into the circular guide path inside the base part which has already been completely machined, neither the cam segment nor the circular path should form a closed circle. The areas forming the tongue-and-groove guidance means on the cam segment on the one hand and the base part on the other hand must be designed on the periphery in such a manner as to allow joining of the joining means. To this end, the intermeshing guidance means of the tongue-and-groove connection of the cam segment on the one hand and the base part on the other hand may each be limited to an arc of 180°. Then it is readily possible to close the tongue-and-groove connection. For such a connection, it is necessary for the arc of the guidance means not to exceed 360°when added together.

Essentially, the tongue-and-groove connection described above between the cam segment and the base part on the outer shaft is capable of ensuring satisfactory operation of the cam with the cam segments, which are rotatable in the direction opposite the first cam, as function parts of the second cams.

In addition, a further improvement can be achieved with the means described below.

This improvement is based on the consideration that the adjusting forces acting on the cam, e.g., in driving a valve tappet in an internal combustion engine, act only radially from the outside to the inside. Consequently, the most stable possible bearing support must be provided only in this direction. Only relatively minor centrifugal forces act toward the outside radially on a movable cam segment during operation of the camshaft. Starting from this consideration, it is proposed according to the present invention that the bearing means be prestressed by spring force in the radial direction inward. With such a prestressed bearing, there is practically no bearing play on the rotary cam segments in operation of such a camshaft.

The arrangement of spring means required to achieve such a bearing prestress may be of a wide variety of types.

An advantageous embodiment may consist of supporting the pin which in turn supports the rotary cam segment in a rotationally fixed manner in the inner shaft and doing so by means of spring force on the inner shaft so that the pin is acted upon by a force acting radially inward. Because of the fixed connection between this pin and the cam segment, in this way, the cam segment is pressed radially inward into its bed which lies in the base part. Suitable spring means include plate springs, spring washers as well as any type of helical springs.

It is also possible to use a spring ring having a meandering course in the plane of the spring within the tongue-and-groove connecting means that runs in an arc. Such a spring ring permits the bearing prestress which is desired according to the present invention directly inside the tongue-and-groove bearing by the fact that the spring force is exerted directly on the opposing bearing flanks. The spring ring may of course be used on the bearing flanks on which it permits prestressing of the bearing of the cam segment toward the inside radially.

In addition, in the case of a spring force acting radially inward on the rotary cam segment, it is essentially also possible to entirely eliminate the arc-shaped tongue-and-groove connection described above between the cam segment and the base part. This is possible because practically only the centrifugal force acting on the cam segment during operation of the camshaft need be reliably by the spring force.

For many applications of an inventive adjustable camshaft, adjustable cam segments without a base circle are sufficient, i.e., then there are second cams consisting exclusively of adjustable cam segments open at the periphery without any base circle areas. In cases in which a base circle area is also available in such cam segments, the function of the base circle can be exercised by a corresponding shape of a base part that is used. The base part may be designed in one piece. However, it is equally possible to secure the position of a base part, which is in two parts in the axial direction of the shaft, on the outer shaft so that it can exercise the function of a one-piece base part. It is also possible for at least one of the parts of a two-part base part to be displaced axially without any change in the angular position after joining it to the camshaft and/or after attachment of the open cam segments.

Furthermore, it is also possible to integrate the first cams into a one-part or multipart basic component of the second cam.

Figure 2:
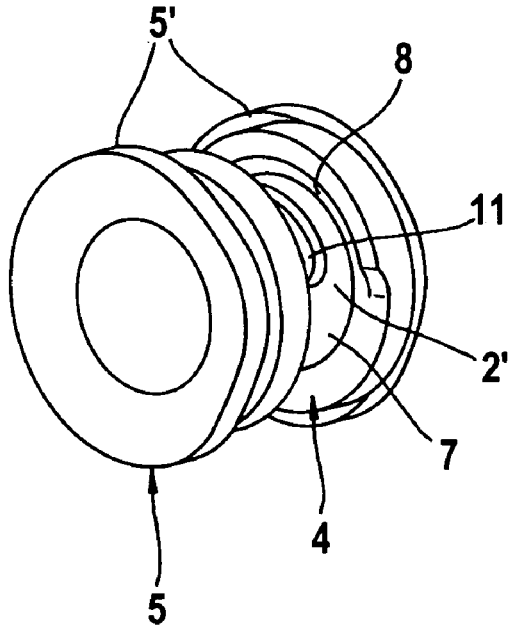
Figure 3:
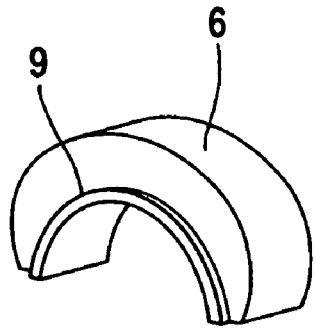
Figure 4:
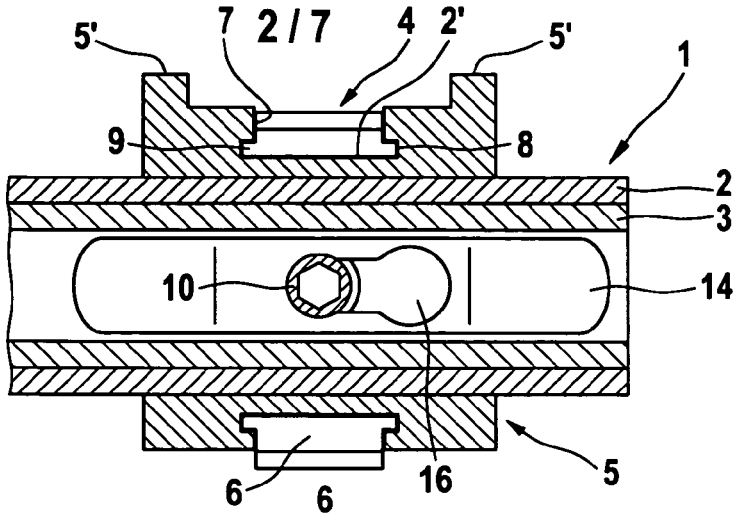
Figure 5:
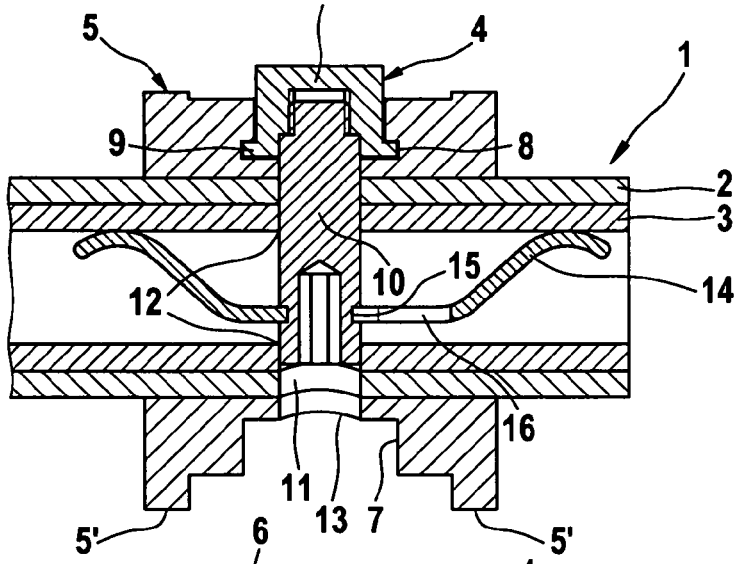
Figure 6:
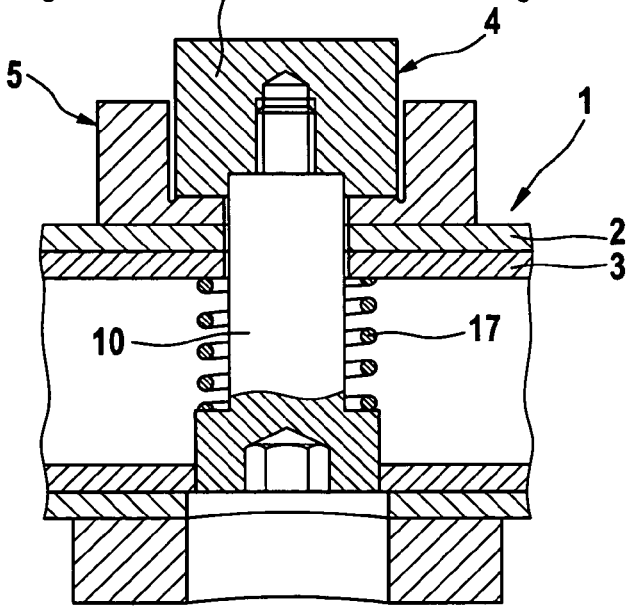
Figure 7:
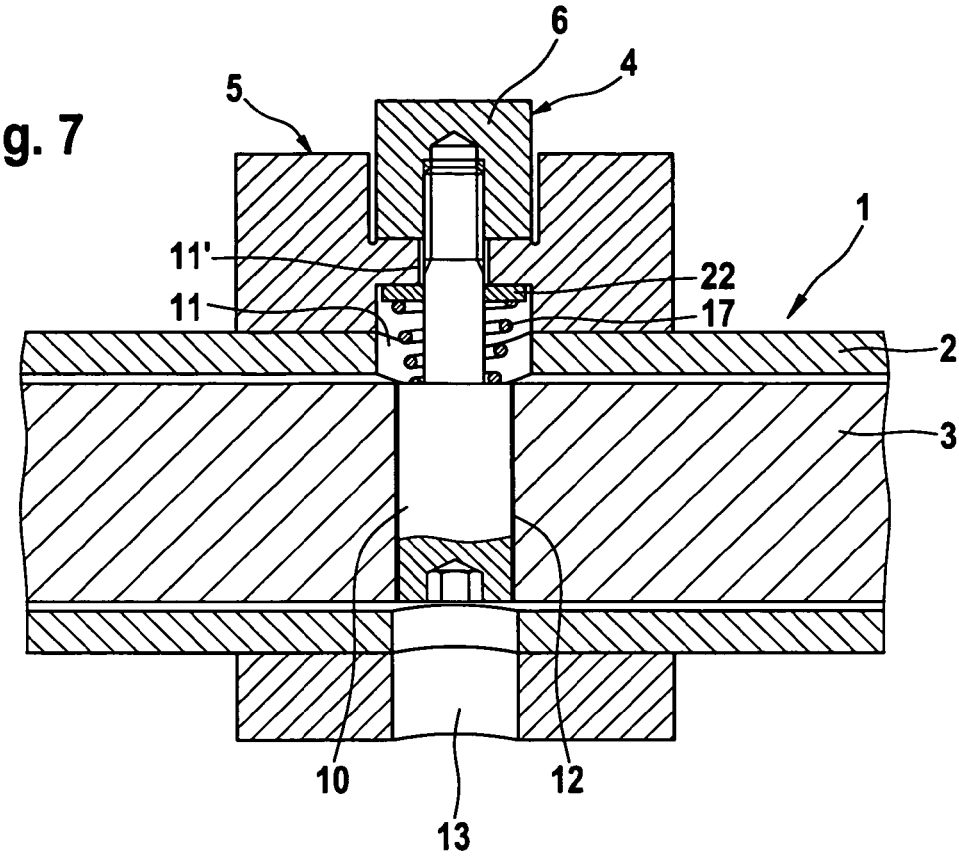
Figure 8:
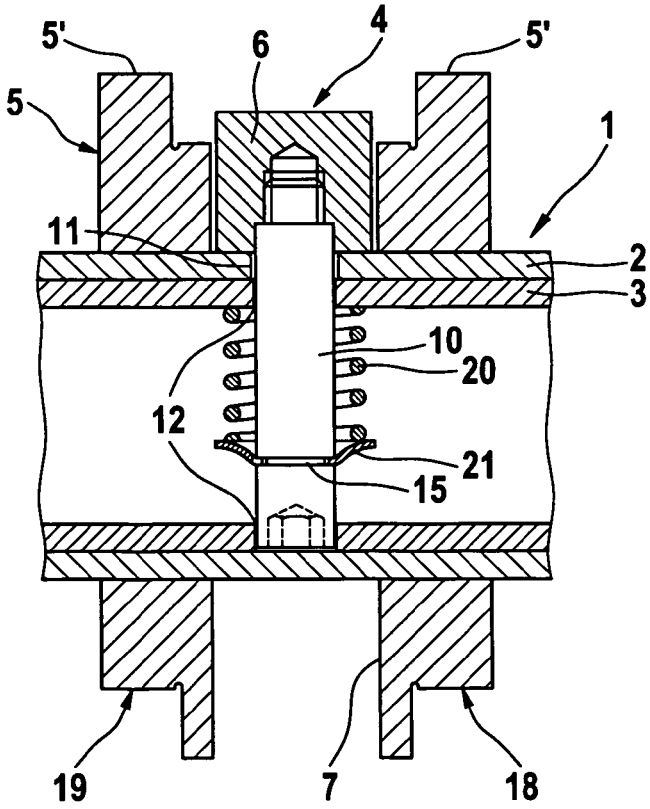
Figure 9:
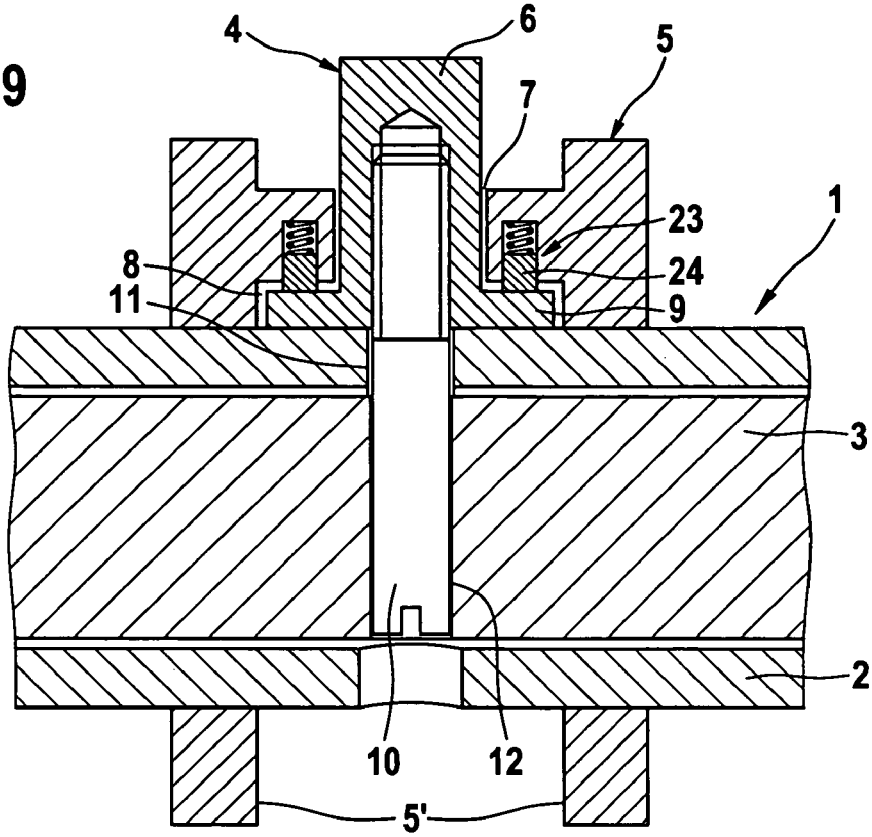
Figure 10:
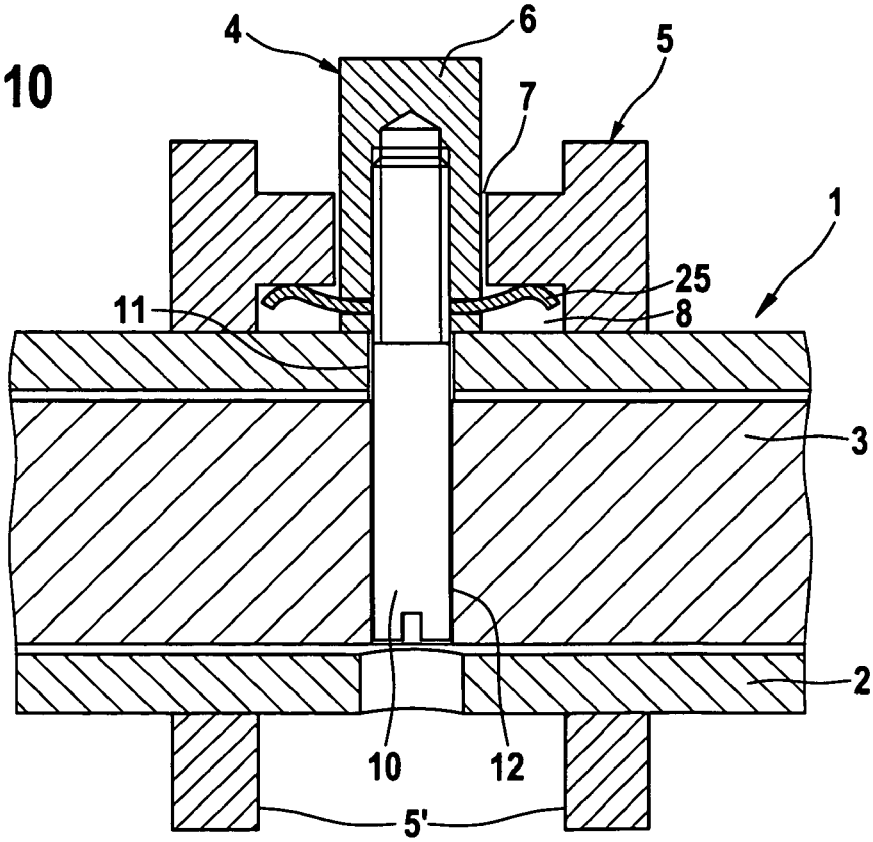
Figure 11A:
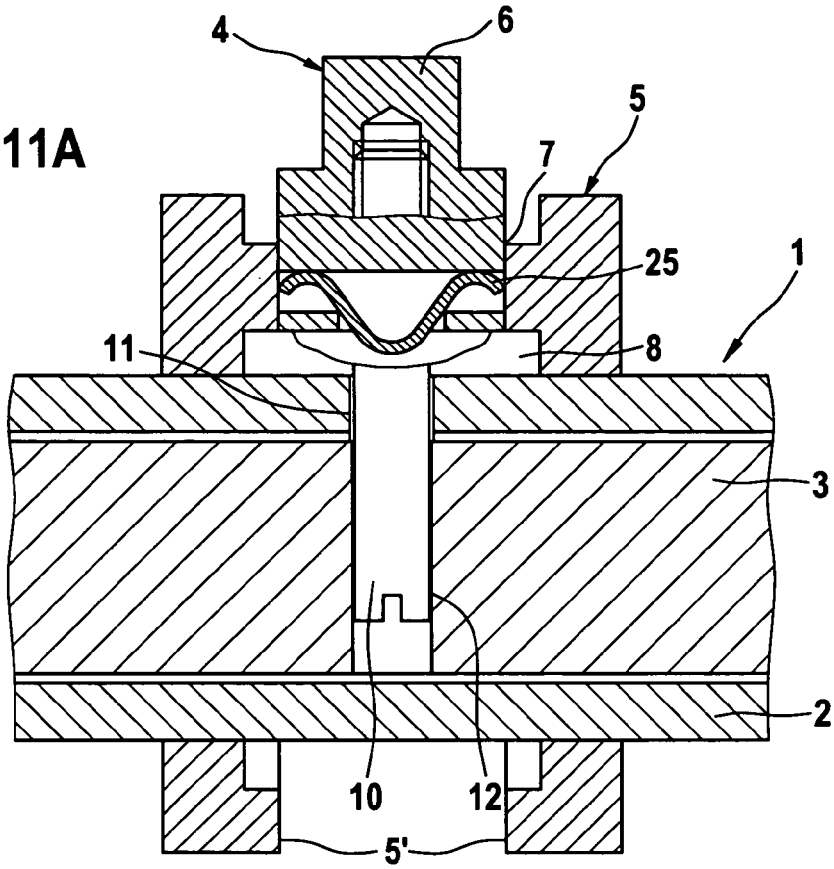
Figure 11B:
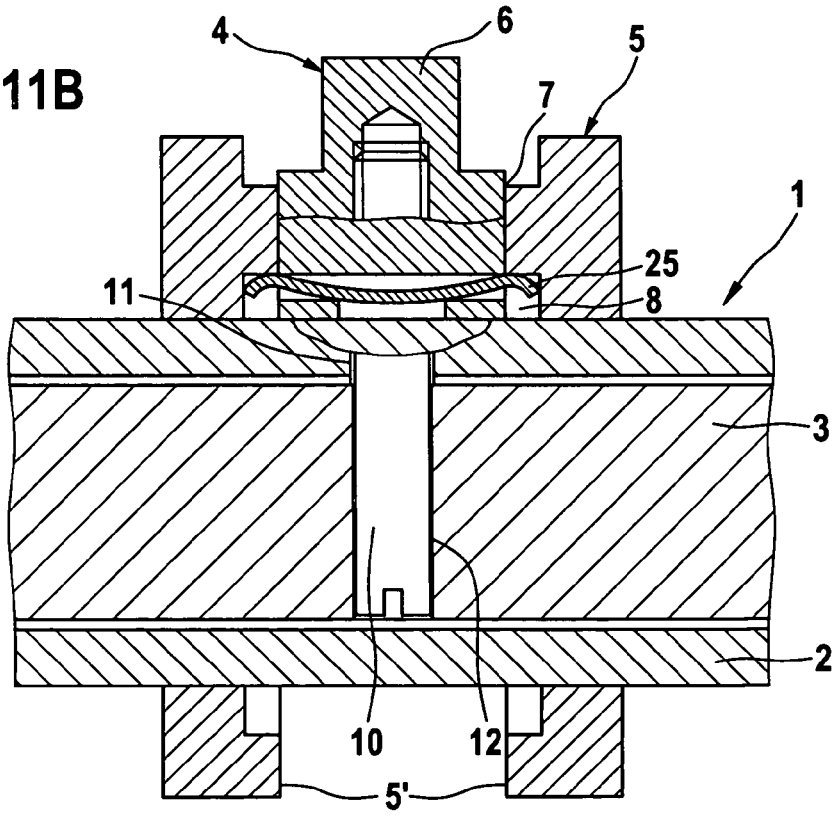
Figure 11C:
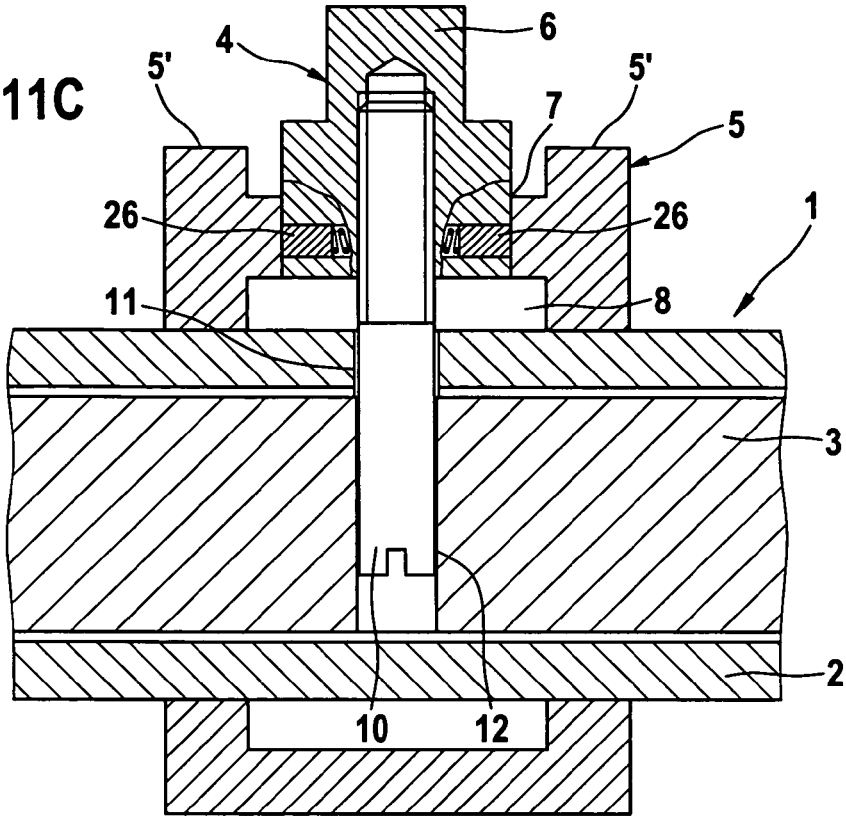
Figure 11D:
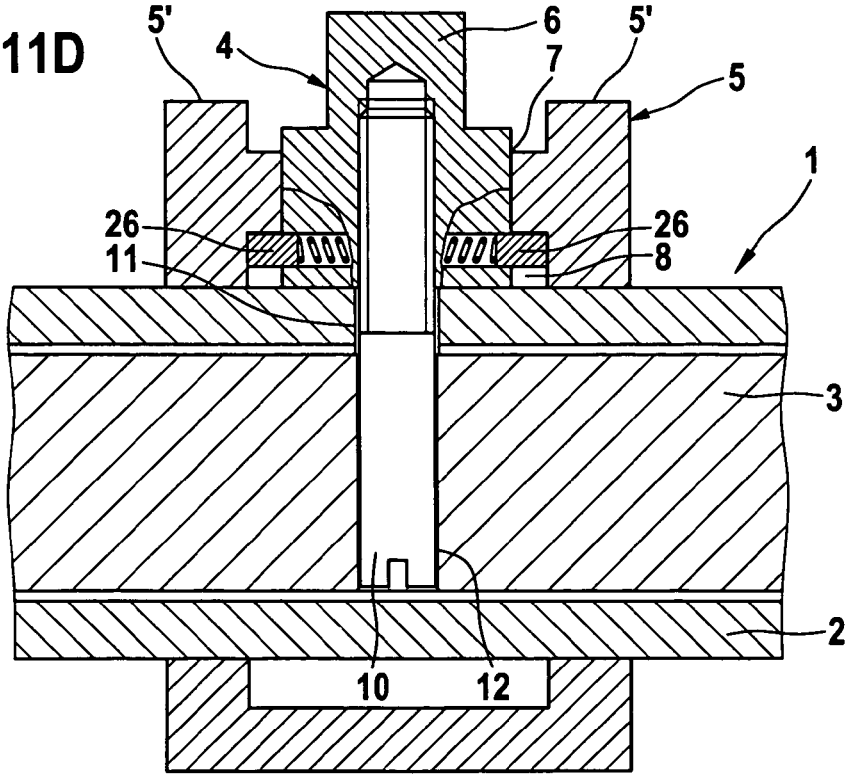
Figure 12:
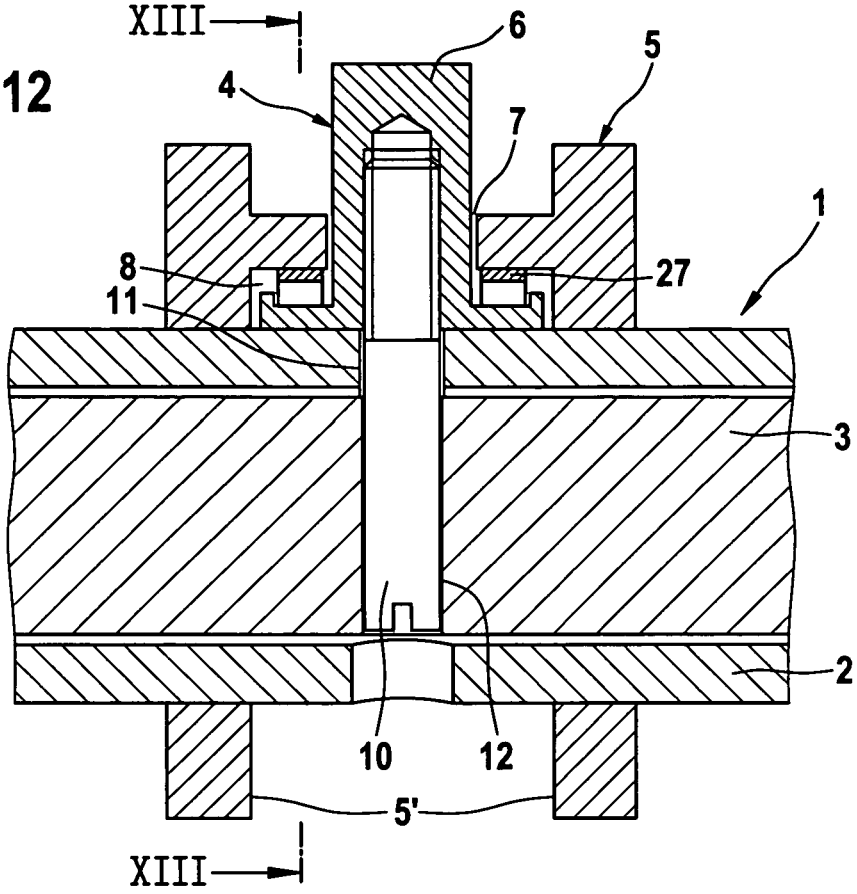
Figure 13:
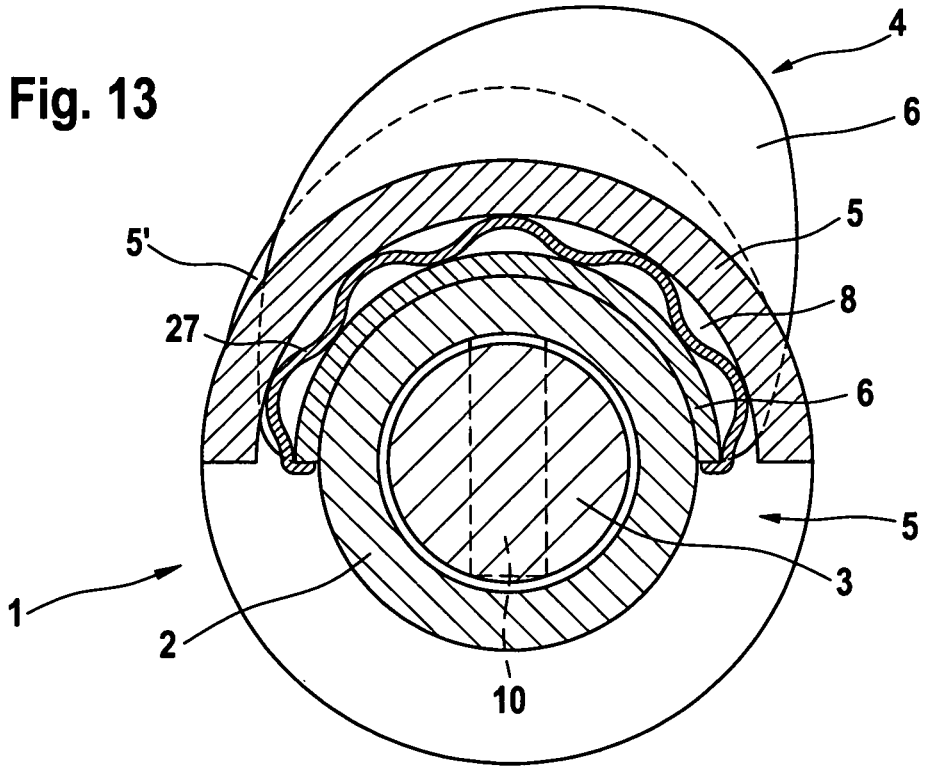

Advantageous and expedient exemplary embodiments of this invention are described in greater detail below and are illustrated in the figures, which show:

FIG. 1 a longitudinal section through a camshaft area with an attached rotary cam segment of a second cam, FIG. 2 a perspective diagram of a base part of the second cam shown in FIG. 1, FIG. 3 a perspective view of the cam segment of the second cam in FIG. 1, FIG. 4 a longitudinal section through a camshaft area with an alternative means of fixation of the movable cam segment of the second cam using a plate spring as the securing means, FIG. 5 the embodiment according to FIG. 3 with a sectional diagram of the camshaft area, offset by 90°, FIG. 6 a variant of the embodiment according to FIGS. 3 and 4 with a helical spring as the securing means, FIG. 7 another variant of the embodiment according to FIGS. 4 through 6 with another spring as the securing means, FIG. 8 a variant of the embodiment according to FIG. 6, FIG. 9 an alternative embodiment of a bearing of the movable cam segment of the second cam prestressed by spring force, FIG. 10 another alternative embodiment of a bearing of the movable cam segment of the second cam prestressed by spring force, FIG. 11 A, B the assembly sequence in the embodiment according to FIG. 10, FIG. 11 C, D the assembly sequence in a modified embodiment of the spring means in comparison with the embodiment according to FIG. 10, FIG. 12 an alternative embodiment of the spring means in comparison with the exemplary embodiment according to FIG. 9, FIG. 13 a section through line XIII—XIII in FIG. 12.

EMBODIMENT ACCORDING TO FIGS. 1 THROUGH 3

An adjustable camshaft 1 includes two oppositely rotating shafts arranged concentrically, one inside the other, namely outer shaft 2 and inner shaft 3. In FIGS. 1 through 3, only a short detail of the length of such an adjustable camshaft 1 with a second cam 4 in particular is shown. This second cam 4 has a base part 5 fixedly connected to the outer shaft 2. This connection may be formed by a shrink fit, for example. A cam segment 6 is rotatably mounted in the base part 5 so that it can rotate about the common axis shared by the outer shaft 2 and the inner shaft 3. This cam segment 6 extends only a partial circumference of the second cam 4. On the inside radially, the cam segment 6 is designed in the form of an arc of a circle, i.e., it has a guide path having such a shape. In the circumferential direction, this arc-shaped segment must not exceed 180°. Otherwise, this cam segment 6 cannot be attached radially to the base part 5.

The cam segment 6 is to be supported radially on the base part 5. In the exemplary embodiment shown here, such support is provided in a circumferential groove 7 in the base part 5. Axially molded ring grooves 8 are situated in the side flanks of the base area of the circumferential groove 7. These ring grooves 8 serve to accommodate and guide the cam segment 6, so that ring webs 9 having a shape complementary to that of the ring grooves 8 are integrally molded on this segment. A "tongue-and-groove connection" is formed between the base part 5 and the cam segment 6 due to this ring groove/ring web design of these two parts. There is a slight play between the ring grooves 8 and the ring webs 9, permitting rotation of the cam segment 6 inside the base part 5. To achieve the tongue-and-groove connection, the grooves 8 on the one hand and the ring webs 9 on the other hand may be provided on only a partial circumference of the respective components so as to permit radial insertion of the cam segment 6 into the circumferential groove 7 in a circumferential area that is not designed as a tongue-and-groove connection.

The cam segment 6 mounted rotatably in the base part 5 forms only the elevated area of a second cam 4 that is outside the cam base circle. When using camshafts where there may be cams that have no base circle, such a design without a base circle is sufficient for a second cam 4 in the form of a cam segment 6. For applications in which a second cam 4 with a cam segment 6 should have a base circle area, the latter may be formed by the base part 5. Likewise, first cams may be designed as integrated components 5' of the base part 5. This base part 5 may be designed in one piece or it may be divided axially. In the case of an axially divided design, the base part 5 consists of two rings spaced a distance apart axially and fixedly connected to the outer shaft 2; between them, these rings may form the one-piece design of the base part 5 described above as a circumferential groove 7 having the same function. Essentially, the function of the base part 5 may also be provided by a corresponding one-piece shaping of the outer shaft 2.

The cam segment 6 is guided radially inside the circumferential groove 7. A pin 10 ensures guidance in the circumferential and axial directions. This pin is fixedly connected to the cam segment 6. Such a connection may be formed, for example, by shrinking the pin 10 in a borehole assigned to the pin 10 inside the cam segment 6. The pin 10 passes through an elongated hole 11 running in the circumferential direction of the outer shaft 2. The angle of rotation of the cam segment 6 with respect to the outer shaft 2 is determined by the length of this elongated hole 11. Inside the shaft 3, the pin 10 is mounted in a receiving borehole 12. The diameters of the pin 10 on the one hand and the receiving borehole 12 on the other hand are designed within the receiving boreholes 12. The pin 10 must merely ensure fixation between the cam segment 6 and the inner shaft 3 in the circumferential direction because of the tongue-and-groove mounting of the cam segment 6 within the circumferential groove 7 of the base part 5. In the radial direction, the cam segment 6 can and should be freely movable within a radial clearance predetermined by the design of the tongue-and-groove connection. In order to allow the pin 10 to be inserted when a cam segment 6 has already been introduced, corresponding insertion openings 13 are provided in the base part 5 and the outer shaft 2. As an alternative, the pin 10 may also be fixedly joined to the inner shaft 3 and to the cam segment 6 by a sliding seating.

The assembly of a second cam 4 comprised of one cam segment 6 and one base part 5 is performed as described below.

The base part 5 is joined to the outer shaft 2 by a shrink fit, for example. With a conventional camshaft having multiple first and second cams, these cams are attached to the outer shaft 2 in a first operation without requiring remachining. The first cams are on the whole fixedly attached to the outer shaft 2. They may be part of components fixedly attached to the outer shaft 2 with the cam segments 6 mounted in them. In the case of the inventive second cams 4, the joining initially takes place only with respect to the particular base part 5 to be fixedly joined to the outer shaft 2 and into which a first cam 5' can be integrated (FIGS. 1, 2).

After the cams, i.e., the base parts 5 of the second cams 4, have been joined completely, the inner shaft 3 is inserted into the outer shaft 2 and the cam segments 6 are inserted radially into a respective circumferential groove 7 of another respective base part 5. The radial attachment of a cam segment 6 to a base part 5 is accomplished by radial insertion into a circumferential area of the circumferential groove 7 that is free of tongue-and-groove connection means with a subsequent creation of the tongue-and-groove connection by rotating the cam segment 6 within the circumferential groove 7 accordingly.

In the next step, a pin 10 is inserted through the radial openings of the base part 5, the outer shaft 2 and the inner shaft 3, including securing the respective pin 10 inside the cam segment 6. The pin can be secured by a shrink fit connection which can be achieved by the fact that the two parts to be joined together are at different temperatures during the joining operation so that a shrink fit is automatically produced as the temperature equalizes.

With this inventive camshaft design, it is especially advantageous that the camshaft 1 can be joined together from completely prefabricated individual parts such that no post-machining of the finished camshaft 1 is necessary.

An alternative manufacturing option consists of grinding the camshaft, which is joined together with the fixed components, to conform to a standard camshaft before assembling the inner shaft 3 and joining the adjustable cam segments 6.

EMBODIMENT ACCORDING TO FIGS. 4 THROUGH 13

These embodiments contain various possible variants for a system that is spring-loaded toward the inside radially with respect to the camshaft axis between the radial contact surface and guidance surface of a rotary cam segment 6 with respect to an opposing guide surface in the base part 5, which is stationary on the outer shaft 2.

The following consideration is taken into account here.

A cam segment 6 guided axially and a base part 5 is subject only to the centrifugal force emanating from it in the radially outward direction during operation of the camshaft. These are relatively minor forces which can be absorbed by a spring. To do so, the spring must be stretched on the cam segment 6 on the one end and on an abutment fixedly attached to the inner shaft 3, for example, on the other end—in the direction opposite the centrifugal force. A corresponding spring force action directly inside an inventive tongue-and-groove connection between the cam segment 6 and the base part 5 is also possible if there is such a connection. The outboard support may also be formed by the outer shaft 2 and/or a base part 5 fixedly connected to the latter.

In the case of a bearing of a cam segment 6 acted upon by spring force, the inventive tongue-and-groove connection may essentially also be omitted. In the base part 5, the cam segment 6 in such a case is subject to a spring force acting toward the inside radially with its inside arc-shaped guide surface.

Therefore, in the case of the embodiment depicted in FIGS. 4 through 6, the inventive tongue-and-groove connection between the cam segment 6 and the base part 5 may be omitted even if it is shown in the figures.

In the embodiment according to FIGS. 4 and 5, the spring force is produced by a plate spring 14. This plate spring 14 is stretched between a support 15 on a pin 10 and the inside circumferential surface of the inner shaft 3. The receiving surface, i.e., the receptacle on the pin 10 for the plate spring 14, forms a receiving ring groove 15 provided in the pin 10. A keyhole-shaped bearing opening 16 is provided in the plate spring 14, so that the plate spring 14 can be anchored in the receiving ring groove 15 through this bearing opening. If an adjustable camshaft 1 has multiple cam segments 6 in the usual manner, then a single plate spring 14 may be used to secure the individual pins 10 of these multiple second cam segments 6. In the exemplary embodiment according to FIGS. 4 and 5, the pin 10 is secured by screwing it into the cam segment 6 by means of a thread. A hexagon socket is provided on the free end of the pin 10 as an aid in screwing in the pin.

In the embodiment according to FIG. 6, the plate spring 14 is replaced by a helical spring 17.

The embodiment according to FIG. 7 shows an exemplary embodiment in which the spring force of a spring is not supported on the inside surface of the inner shaft 3 but instead is supported on the base part 5 of a second cam 4 which is fixedly connected to the outer shaft 2. This is advantageous in particular because the inner shaft 3 is not under load with respect to the outer shaft 2. The spring 17 is arranged in the area of the elongated hole 11 of the outer shaft 2 between the contact surface on the pin 10 and a bearing washer 22 which covers another elongated hole 11' in the base part 5 of the second cam 4. The bearing washer 22 surrounds the pin 10 in a form-fitting manner such that the bearing washer 22 slides in the circumferential direction along a guide surface provided in the base part 5 in the case of a relative rotation of the cam segment 6 with respect to the inner shaft 3.

FIG. 8 shows an exemplary embodiment in which no tongue-and-groove connection is provided between a cam segment 6 and a respective base part 5. The radial support here is provided only by contact of the cam segment 6 with the outer shaft 2. This means that in this case there is a base part 5 consisting of two rings 18, 19 connected directly and fixedly to the outer shaft 2. These two rings 18, 19 are joined to the outer shaft 2 at an axial distance such that the cam segment 6 situated between them is positioned loosely axially while axial guidance with respect to the inner shaft 3 is assumed by the pin 10. The spring force is created by a helical spring 20 which is stretched under tension between a support of the pin 10 and the inside circumferential surface of the inner shaft 3. The support 21 on the pin 10, which is fixedly joined to the cam segment 6, forms a locking ring which can be secured in a ring groove of the pin 10 in the usual manner and may be, for example, a spring ring or a push-on ring with locking abutments that engage in the ring groove of the pin 10. In the drawing, this support is labeled as 21. In this embodiment, the pin 10 is already connected to the cam segment 6 already before its assembly and is connected to the support 21 when this module 6, 10 is introduced through the opening 11 into the inner shaft 3. This support 21 and the spring 20 are positioned in the interior of the shaft 3 prior to assembly and are optionally held in this position by auxiliary means until the procedure of joining it to the pin 10.

FIG. 9 shows an exemplary embodiment in which one or more holding elements 23 which secure the position of the cam element 6 without any radial play by means of spring-loaded pins 24, preferably radially toward the inside.

In the example according to FIG. 10, the elements which cooperate with the groove 8 are preferably spring elements 25 which are prestressed for radial positioning of the cam segment 6 without any play. This is advantageous in particular because a cam segment 6 can be manufactured easily and with a high precision before assembly of the holding elements. When the spring elements 25 are used, a number of functions can be combined with the use of simple and advantageous individual components. Furthermore, assembly in a closed groove profile 8 is possible with this embodiment if the spring elements 25 are used such that they are prestressed so that the width of the cam segment 6 is not exceeded at the point in time of assembly (FIG. 11 A). After cam segment 6 has reached the desired radial position, the spring element 25 is relaxed, preferably automatically, e.g., by contact with the base part, so the ends of the spring element 25 engage in the groove 8 of the base element 5 and thus can ensure radial positioning (FIG. 11 B). Alternatively, pins 26 that are displaceable with spring support in the longitudinal axis of the camshaft may also be used (FIGS. 11 C and D).

The spring shown in FIGS. 12 and 13 is shaped like a semicircular ring having a meandering, radially elastic circumference and can be inserted between the tongue-and-groove guide as a bearing prestressing means in an embodiment according to FIGS. 1 and 9.

All the features described in the description and characterized in the following claims may be essential to this invention either alone or in any desired form.

The invention claimed is:

1. A camshaft for automotive engines, comprising at least one first cam (5') and at least one cam segment (6) which is rotatable to a limited extent with respect to the first cam (5') and exercises the full or partial function of a second cam (4), with which an inner shaft (3) and an outer shaft (2) are arranged concentrically, one inside the other, and also rotatably with respect to one another, the first cam (5') and the cam element (6) surround the outer shaft (2) on the periphery at least in part, the first cam (5') is fixedly connected to the outer shaft (2) and the respective cam segment (6) is connected to the inner shaft (3) in a rotationally fixed manner, the cam segment (6) is provided with an inside circumferential surface extending over only a section of the circle running concentrically in a circular cylindrical pattern with respect to the inner shaft and outer shaft (3, 2), the inside circumferential surface of the cam segment (6) is supported on a guidance area (2') formed by the outer shaft (2) or fixedly connected to it, comprising the features the cam segment (6) is mounted on the guidance area (2') assigned to the outer shaft (2) by means of a tongue-and-groove connection (8, 9) which runs on a circular section limited at the circumference, whereby the circular section is designed to be coaxial with the outer shaft and inner shaft (2, 3), the cam segment (6) which is connected to the inner shaft in a rotationally fixed manner is displaceable with respect to the inner shaft (3) to a limited extent radially.

2. The camshaft according claim 1, wherein the guidance area (2') for the cam segment (6) assigned to the outer shaft (2) is formed by a base part (5) fixedly connected to the outer shaft (2).

3. The camshaft according to claim 2, wherein the base part (5) together with the cam segment (6) guided in it forms a function area of the second cam (4).

4. The camshaft according to claim 2 wherein a first cam (5') is designed as an integral component of the base part (5).

5. The camshaft according to claim 1, wherein the cam segment (6) is acted upon by a force loading the cam segment (6) toward the inside radially in the direction running radially to the inner shaft and the outer shaft (2, 3).

6. The camshaft according to claim 5, wherein the force acting upon the cam segment (6) is exerted by a spring (14, 17, 20).

7. The camshaft according to claim 5, wherein the force applying a load to the cam segment is exerted by spring means (27) whereby the spring means (27) forms a circular arc segment with a meandering extent and are clamped within the tongue-and-groove connection (8, 9) between the cam segment (6) and the base part (5)—pressing the cam segment (6) against the base part (5).

8. The camshaft according to claim 1, wherein the means for a rotationally fixed connection between the cam segment (6) and the inner shaft (3) include a connecting element (10) which is fixedly connected to the cam segment (6) and runs radially to the inner shaft (3), whereby the spring (14, 17, 20) is supported between the connecting element (10) and the interior of the inner shaft (3).

9. The camshaft according to claim 1, wherein the spring is designed as a plate spring, a spring washer or a helical spring (14, 17, 20).

10. The camshaft according to claim 9, wherein the plate spring (14) has an opening (16) whose opening edge is supported on an abutment (15) of the connecting element (10).

11. The camshaft according to claim 10, wherein the abutment (15) is designed as a groove or as a stop acting on one side.

12. The camshaft according to claim 1, in which the cam segment (6) and the inner shaft (3) are joined together in a rotationally fixed but radially mutually displaceable manner.

* * * * *